US009654884B2

(12) United States Patent
Hug et al.

(10) Patent No.: US 9,654,884 B2
(45) Date of Patent: May 16, 2017

(54) METHOD OF FITTING A HEARING INSTRUMENT, AND IMPRESSION TOOL

(71) Applicant: Sonova AG, Stäfa (CH)

(72) Inventors: Roland Hug, Hinwil (CH); Alfred Stirnemann, Zollikon (CH); Christian Frei-Krumme, Stäfa (CH); Daniel Probst, Uerikon (CH); Hilmar Meier, Herrliberg (CH); Martin Roth, Hombrechtikon (CH); Markus Leuthold, Stäfa (CH)

(73) Assignee: Sonova AG, Staefa (CH)

( * ) Notice: Subject to any disclaimer, the term of this patent is extended or adjusted under 35 U.S.C. 154(b) by 46 days.

(21) Appl. No.: 14/892,531

(22) PCT Filed: May 21, 2013

(86) PCT No.: PCT/CH2013/000085

§ 371 (c)(1),
(2) Date: Nov. 19, 2015

(87) PCT Pub. No.: WO2014/186910

PCT Pub. Date: Nov. 27, 2014

(65) Prior Publication Data

US 2016/0112814 A1 Apr. 21, 2016

(51) Int. Cl.
*H04R 25/00* (2006.01)
*H04R 25/02* (2006.01)

(52) U.S. Cl.
CPC ..... *H04R 25/30* (2013.01); *H04R 25/02* (2013.01); *H04R 25/652* (2013.01); *H04R 25/658* (2013.01); *H04R 25/70* (2013.01); *H04R 2225/021* (2013.01); *H04R 2460/15* (2013.01)

(58) Field of Classification Search
CPC ..... H04R 25/30; H04R 25/305; H04R 25/70; H04R 25/652; H04R 25/658; H04R 2460/11; H04R 2460/15
See application file for complete search history.

(56) References Cited

U.S. PATENT DOCUMENTS 3,098,127 A * 7/1963 Huth ..... H04R 25/402 381/322
3,882,848 A * 5/1975 Klar ..... A61B 5/121 181/135
4,429,702 A 2/1984 von Recklinghausen
(Continued)

FOREIGN PATENT DOCUMENTS

DE 2941817 A1 4/1981
EP 2434779 A2 3/2012

OTHER PUBLICATIONS

PCT Search Report dated Jan. 28, 2014 for PCT App. Ser. No. PCT/CH2013/000085.

*Primary Examiner* — Matthew Eason
(74) *Attorney, Agent, or Firm* — Henricks, Slavin & Holmes LLP

(57) ABSTRACT

In accordance with an aspect of the invention, a method of fitting a hearing instrument to a user's ear is provided. The method comprises taking an impression of the user's ear canal and manufacturing, based on geometrical data of the impression, an earmold. In accordance with the aspect of the invention, the method comprises the further step of performing an acoustical measurement while the impression is being taken.

14 Claims, 2 Drawing Sheets

(56) References Cited

U.S. PATENT DOCUMENTS

| | | | | |
|---|---|---|---|---|
| 8,254,587 | B2 * | 8/2012 | Voix | A61F 11/08 181/135 |
| 2002/0076057 | A1 * | 6/2002 | Voix | A61F 11/08 381/60 |
| 2003/0139658 | A1 | 7/2003 | Collier et al. | |
| 2004/0020710 | A1 * | 2/2004 | Martinez | H04R 25/456 181/130 |
| 2006/0137934 | A1 * | 6/2006 | Kurth | A61F 11/08 181/135 |
| 2006/0222195 | A1 * | 10/2006 | Bramslow | H04R 25/453 381/318 |
| 2009/0122996 | A1 * | 5/2009 | Klein | H04R 29/00 381/56 |
| 2009/0129619 | A1 * | 5/2009 | Nordahn | H04R 25/70 381/328 |
| 2010/0074451 | A1 * | 3/2010 | Usher | H04R 25/70 381/58 |
| 2012/0076313 | A1 | 3/2012 | Junius et al. | |
| 2015/0092948 | A1 * | 4/2015 | Usher | H04R 25/70 381/58 |
| 2016/0037278 | A1 * | 2/2016 | Voix | A61F 11/08 381/58 |
| 2016/0241967 | A1 * | 8/2016 | van 't Hof | H04R 25/30 |

* cited by examiner

METHOD OF FITTING A HEARING INSTRUMENT, AND IMPRESSION TOOL

CROSS-REFERENCE TO RELATED APPLICATIONS

This application is the U.S. National Stage of PCT App. Ser. No. PCT/CH2013/000085, filed May 21, 2013.

FIELD OF THE INVENTION

The invention is in the field of fitting hearing instruments. It especially relates to a method of fitting a hearing instrument to a user's ear.

BACKGROUND OF THE INVENTION

To fit to the anatomies and individual characteristics of a user, hearing instruments are adapted by a standard procedure, for example as follows. In a first step, the hearing instrument is calibrated against a coupler. Also, an ear canal impression is taken in order to manufacture an ear mold. After the ear mold and the hearing instrument are manufactured, they are combined, and the Real-Ear-to-Coupler Difference (RECD) that, among others, accounts for the parameters 'ear canal residual volume' and 'ear drum impedance' is either estimated or measured.

Usually when the ear mold is available, the RECD is estimated with rather high error, leading to a bad initial fit. Alternatively, the RECD is measured in-situ. However, this in-situ RECD measurement is time-consuming and uncomfortable for the user as well as for the fitter, and the measurement accuracy is normally unknown.

U.S. Pat. No. 4,412,096 proposes to make an impression of a fast-curing material and to insert (press) a hearing aid receiver adapter into the impression. The resulting combination is then used for fitting and evaluating hearing aids. Especially, electroacoustic frequency response curves are measured. To this end (although not explicitly mentioned in U.S. Pat. No. 4,412,096), a probe tube microphone is required. The dimensions of the fast curing impression are changed upon insertion of the hearing aid receiver adapter, so that a tighter fit in the ear is achieved. This is perceived as an advantage according to U.S. Pat. No. 4,412,096, especially for reducing the possibility of acoustic feedback in fittings for patients with severe hearing loss. However, the method taught in U.S. Pat. No. 4,412,096 does not solve the problem of inaccuracies due to differences between the test set-up and the later use of the real hearing instrument.

It has already been proposed in PCT/CH2011/000277 to estimate the RECD by an impedance measurement using an ear canal microphone of an inserted hearing instrument.

It is an object of the present invention to provide a method of fitting a hearing instrument to a patient's (user's) ear, which method overcomes drawbacks of prior art methods, and which method especially reduces fitting efforts, is comfortable for the patient as well as the fitter and improves the first fit acceptance.

SUMMARY OF THE INVENTION

The invention concerns a method and an impression tool as defined in the claims. Especially, in accordance with an aspect of the invention, a method of fitting a hearing instrument to a user's ear is provided, the method comprising taking an impression of the user's ear canal and manufacturing, based on geometrical data of the impression, an earmold, the method comprising the further step of performing an acoustical measurement while the impression is being taken.

Especially, the acoustic measurement may be an impedance measurement.

In this, the earmold may be an earpiece of a hearing instrument comprising components outside of the ear. As an alternative, the earmold may be the housing of an in-the-ear hearing instrument (the definition of "in-the-ear hearing instrument" used in this text includes "in-the-canal" hearing instruments and "completely-in-the-canal" hearing instruments).

The invention features the substantial advantage that a process that is required in many cases anyway (namely, the impression taking for later earmold manufacturing), can be used for the acoustic fitting process. This may produce a reduced need for additional fitting sessions resulting in a comfort gain.

Further, the important acoustic properties of the ear canal are available at an earlier stage in the process than in accordance with prior art approaches. Especially, knowledge gained from the acoustic measurement may be incorporated in the last steps of the hearing instrument design—both, when designing the earmold and when designing (other) acoustically relevant components such as the tubing (chose of diameter and material properties) or a hook or the like.

Also, the receiver output of the hearing instrument may be adapted for example by a horn and/or a winded tubing or the like.

In addition or as an alternative, the selection of the hearing instrument chosen for the user may be made dependent on the data obtained in the measurement.

The tool used for impression taking need not be removed or re-inserted for the process.

The tool used during impression taking may comprise at least one measurement tube reaching from an outside (where it is connected to a microphone and a receiver) to an inner (deep) end of the tool where the tube opens into the remaining volume between the tool and the eardrum.

In accordance with a first possibility, a single measurement tube may be used, which measurement tube may be connected to both, the receiver and the microphone. (If the microphone and the receiver are coupled to the remaining volume in the ear canal via a same tube, sound may get from the receiver to the microphone directly without being first coupled into the ear canal; this may be taken into account calculationally). Alternatively, a plurality of tubes may be present, for example one connected to the receiver and an other one connected to the microphone. This allows to more easily acoustically decouple the microphone input from the receiver output. If a plurality of tubes are uses, these may be of a same or of different lengths and/or diameters, and they may be combined in one tube element with multiple inner tubes.

It is also possible to provide an even further tube for separate pressure equalization; such a further tube may correspond to the vent of a later inserted earmold and may, for the sake of the measurement, be accordingly dimensioned. This further tube may also be used to apply a static pressure like in tympanometers.

In accordance with a possibility, subsequently performed measurements through a thinner and a thicker tube may be carried out, for example either with microphone and receiver using the same tube in the first step and the other tube in a $2^{nd}$ step, or in a first step with the microphone connected through the thin and the receiver through the thick tube, and in a $2^{nd}$ step vice versa. This may yield even more significant results, because the difference is a parameter indicative of the influence of the acoustical path through the tubing, which may, if the two measurements are present, be taken into account more precisely.

The measured ear canal impedance is for example the ratio of the sound pressure level and of the sound flow produced by the receiver. For example, it may correspond to the sound pressure level in the sound entrance plane and of the sound flow in the same plane. It is possible to transform this from one plane to another one.

The sound entrance plane may be the plane in which the tubing from the receiver opens into the ear canal rest volume; this plane may correspond to the plane in which also the tubing from the microphone opens into the ear canal (both, if the receiver and the microphone connect to a same tube or if different tubes are used for receiver and microphone).

As taught in PCT/CH2011/000277, a simplified impedance measurement that takes into account reference data of the hearing instrument, for example coupled to a standard coupler, and a simple measurement of the sound pressure by an ear canal microphone can be used to estimate the impedance in the ear. The fact that data gained on a single standard coupler can be used as a useful input for determining the impedance of a real ear canal is surprising. One reason for this is that it has been found that in a hearing instrument, the receiver can be approximated to be an ideal sound flow source, so that the sound flow produced by the receiver becomes approximately independent on the acoustic impedance that it is coupled to. Due to this insight it becomes possible to use sound signal data recorded from measurements on a single standard volume for determining the real ear canal impedance.

Further, as taught in PCT/CH2011/000277, the ear canal impedance—more in particular an impedance at a sound entrance plane—is a good input quantity for calculating a sound pressure transfer quantity such as the Real-Ear-to-Coupler-Difference (RECD). Especially, as taught in PCT/CH2011/000277, under the verified assumption that the source impedance is high (this is especially the case for short and thin tubings) the RECD can be approximated to be $RECD=Z_{trans}/Z_{2cc}$, where $Z_{trans}$ is the transfer impedance being the ratio of the sound pressure $p_{dr}$ at the eardrum and the sound flow $q_o$ in the sound entrance plane, and $Z_{2cc}$ is the impedance in the 2 cc coupler that can be easily obtained. From there, the following expression is obtained:

$$RECD = \frac{Z_{trans}}{Z_{2cc}} = \frac{e_{22}Z_{ec} - e_{12}}{Z_{2cc}} = e_{22}\frac{p_{ec}}{p_{2cc}} - \frac{e_{12}}{Z_{2cc}}$$

(with $p_{cc}$ being the sound pressure in the ear canal that can be easily measured during impression taking, and $p_{2cc}$ the correspondingly obtained sound pressure in the 2 cc coupler). The parameters/coefficients $e_{12}$ and $e_{22}$ in the above equation depend on the ear canal geometry and need to be estimated.

In accordance with an approximation, the parameters are estimated to be $$e_{12} = j\frac{\rho c}{A}\sin(kl),$$

$e_{22}=\cos(kl)$, where l is the length of the remaining volume in the ear canal and A is the cross section. The quantity l can be estimated by the analysis of the impedance breakdown at the λ/4 resonance. If the latte occurs at a frequency $f_0$, then $$l = \frac{c}{4f_0}.$$

In addition to this approximation, PCT/CH2011/000277 also teaches other models for obtaining the RECD from the measured ear canal impedance, including statistical models.

An impedance measurement thus may be done in order to estimate the influence of the rest volume and of the ear drum impedance on the acoustic transfer to the eardrum. This can be done with given calibrated acquisition equipment, which includes a receiver and a microphone, and with a known connector and tubing. In this, the tubing is a part of the impression and can be perfectly taken account of in the lab within the impression or by the fitter as a post-calibration.

Also other acoustic parameters can be estimated based on measurements performed during impression taking, for example the REOG. Methods of estimating the REOG from the measured ear canal impedance are also taught in PCT/CH2011/000277.

In accordance with a first possibility, the impression is taken by an impression taking material that fills parts of the ear canal and hardens during impression taking. After removal, the hardened material forms the impression. In embodiments of this first possibility, the impression taking material during impression taking is delimited towards the interior of the ear (the inner, medial side) by an deformable impression stop, which is made of an elastically deformable material, for example an elastically deformable foam.

The impression stop is deformed in the ear, and the real volume taken during impression taking (and measurement) by the impression stop material is therefore an unknown quantity. Therefore, in accordance with preferred embodiments, the impression stop is made of an acoustically transparent material. This material could be an open porous foam or a textile material.

In accordance with a second possibility, the impression is taken as an impression scan and thus comprise optically scanned geometrical data. For example, an inflatable element may be used. Such inflatable element may optionally be filled by a fluorescent or otherwise optically detectable material. In this, the impression may then be formed by the optically scanned geometrical data of the inflatable element and/or (if applicable) its content.

The acoustic properties of the impression material (in embodiments in which the impression is taken by a hardenable material) or of the inflated element (in embodiments with an optically scanned inflatable element) may differ from the acoustic properties of the to-be-manufactured earmold, and this may have an influence on the results of the acoustic measurement. For example, the material properties may have some influence on the impedance of the ear canal. However, material properties and geometries of both, the impression material/the inflated element and the earmold are exactly known. Therefore, there is no uncertainty resulting from this difference; rather, it may be taken into account in any calculation of the acoustic properties of the ear canal.

As an option, a tympanogram measurement equipment can be used in combination with the tool. The tympanogram measurement equipment in this can be connected to the connector (that connects to the tube(s) of the tool) in order to provide the ear drum and middle ear diagnosis before the ear mold production. Alternatively, the tympanogram measurement equipment can even be combined with the impedance measurement equipment so that the receiver and microphone of the tool can also be used for the tympanogram measurement.

The possibility of putting the remaining volume between the tool and the eardrum under an excess pressure or underpressure may also be used for estimating the size of this remaining volume. If the flow of air pumped into (or out of) the remaining volume is known and the resulting pressure difference is measured, the volume can be estimated therefrom under the laws of thermodynamics. Estimates of the size of the remaining volume may supplement or even replace the estimates used in the above-discussed equations for the RECD.

In addition or as an alternative, parameters of pressure equalization (air flow; temporary pressure differences) can be measured during insertion in order to estimate the rest volume between the tool and the eardrum.

After impression taking, the ear impression is used to manufacture the earmold; in this the ear impression including the tubing for the impedance measurement is used. For manufacturing, the ear impression may be scanned, and the earmold is defined using the individual ear canal information, for example adapting the receiver output to the individual ear by a horn or some winded tubing. Everything that is—digitally—cut from the ear impression for the earmold manufacturing (for example by Rapid Shell Modeling (RSM)) is well-known and exactly defined and is taken account of for the calculation.

The relevant individual ear canal information relevant for the individual ear mold may be stored in the hearing instrument and/or in a database of the fitter and/or in a database of the ear mold manufacturer. In addition or as an alternative, as mentioned above, the data may be used by the fitter to influence the choice and/or design of the hearing instrument. Therein, the fitting software may propose to the best choice for the HI selection with respect to the gathered real-ear data.

The invention also concerns an impression tool suitable for carrying out the method, the impression tool comprising a flow stop for confining the flow of impression material in the ear canal or an inflatable element that can be inflated in the ear and further comprising at least one measurement tube and an acquisition system with a receiver and a microphone connected or connectable to the at least one measurement tube and an electronics unit connected to the receiver and the microphone, the acquisition systems being capable of producing the sound signal in the ear canal and of performing the acoustic measurement.

In this, the acquisition system may optionally be integrated in a behind-the-ear component of a hearing instrument. Such a behind-the-ear component could belong to a wired or wireless hearing instrument. Generally, the evaluation can be done in the hearing instrument or by a fitting software running on a separate device.

For the part of the impression tool that goes into the ear canal, existing impression tools can be used, which need not be adapted (or with only the tube adapted, for example to comprise a plurality of tube lumens.

The impression tool may further optionally comprise or be combined with further tools such as a tympanometer, a visual control tool and/or a visual diagnosis tool, etc. The impression tool may also comprise means for measuring a pressure difference and/or an airflow of air escaping from the ear canal during insertion of the tool due to pressure equalization.

BRIEF DESCRIPTION OF THE DRAWINGS

Hereinafter, embodiments of methods and devices according to the present invention are described in more detail referring to Figures. In the drawings, same reference numerals refer to same or analogous elements. The drawings are all schematical.

DESCRIPTION OF THE PREFERRED EMBODIMENTS

Figure 1:
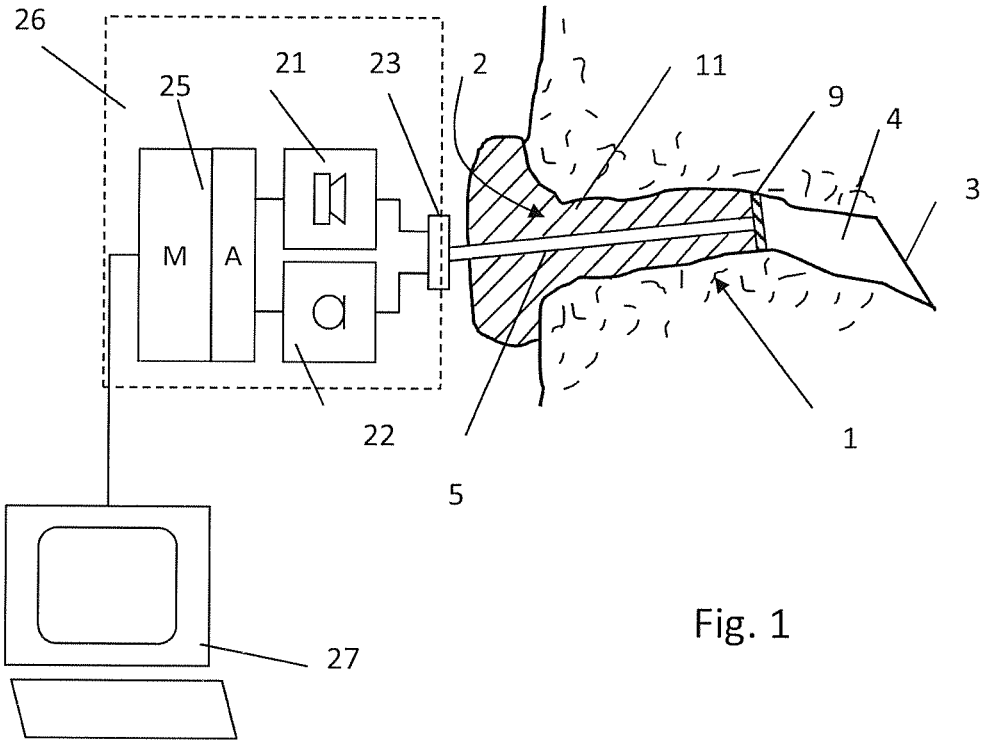
FIG. 1 shows an ear canal during impression taking, with equipment to perform the method according to the invention.

FIG. 1 schematically illustrates an ear canal extending between an outer end 2 (the earshell of the outer ear is not shown in the figure) and the tympanic membrane (eardrum) 3. FIG. 1 also illustrates a set-up for impression taking. The impression tool comprises a tube 5 that serves for pressure equalization, and that also is used as mechanical backbone of the tool. Further, in the described embodiment the tube is also a measurement tube. At the deep end, the tool comprises an impression stop 9 delimiting the flow of the impression material towards the inner side so that a remaining volume 4 between the impression stop 9 and the eardrum 3 is kept free of the impression material. The impression stop 9 may be made of an open porous foam or textile material or a material with similar acoustical behavior.

In FIG. 1, the ear canal is shown filled in parts with a an impression material 11 that is introduced in a state in which it is liquid (with a considerably high viscosity) or pasty and that hardens to a state where it is dimensionally stable.

In a special variant (which can be used for all embodiments of the invention, including embodiments that comprise an optical scan impression taking), the tube may be comparably flexible and have a low stiffness initially, and after insertion may be made stiffer, for example by UV lightening.

Figure 3:
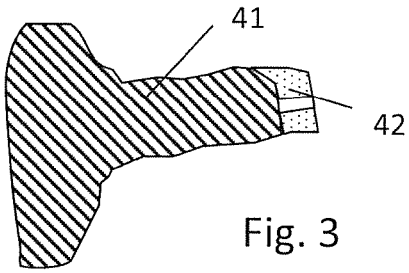
FIG. 3 shows the outer shape of an earmold.

The tool also comprises a receiver 21 and a microphone 22, both in acoustic communication with the tube. FIG. 3 shows a connector 23 connecting the tube with the unit comprising the receiver 21 and the microphone 22. Sound emitted by the receiver is emitted into the tube 5 and from there into the remaining volume 4. Sound coming back from the volume through the tube 5 is picked up by the microphone 22. The receiver 21 and the microphone 22 are connected to an electronics unit 25 that feeds the receiver 21 and acquires signals from the microphone 22. A comparison between the electric signal fed to the receiver (the electric receiver signal) and the measured microphone signal yields an impedance measurement.

The acquisition system 26 that comprises the receiver 21 and the microphone 22 as well as the electronics unit 25 may be integrated in a behind-the-ear (BTE) component that is mounted so that care is taken that the ear-impression is not influenced by the BTE. In principle, it is possible to use a standard BTE hearing instrument that is correspondingly programmed as the acquisition system of the tool.

The result (for example a frequency dependent impedance) is available to a fitting software 27. The software may run on a unit (especially computer) that is connected to the acquisition system wired or wireless.

Any combinations with visual control tools (for example a light bar tool for positioning of the impression stop) or visual diagnosis tools (for example image capturing) can be applied. This holds for all embodiments of the invention.

In PCT/CH2011/000277, the content of which is incorporated herein by reference in its entirety, a method of estimating an acoustic transfer quantity (especially the RECD) indicative of the sound transfer to the eardrum is known. In this, a microphone in acoustic communication with the remaining volume is used to measure the ear canal acoustic impedance, i.e. the ratio of the sound pressure level in a sound entrance plane measured by the microphone and of the sound flow in the same plane. The sound entrance plane may be the plane in which the tubing from the receiver opens into the ear canal; this plane may correspond to the plane in which the tubing from the ear canal microphone opens into the ear canal. The sound flow may be determined from the input signal of the receiver, because it has been found that that in a hearing instrument, the receiver can be approximated to be an ideal sound flow source, so that the sound flow produced by the receiver becomes approximately independent on the acoustic impedance that it is coupled to.

Also from PCT/CH2011/000277, approaches of estimating the transfer impedance $Z_{trans}=p_{dr}/q_{ec}$ (dr=eardrum ec=ear canal) or the closely related RECD from the measured ear canal impedance $Z_{ec}=p_{ec}/q_{ec}$ are known, for example from a geometrical parameter of the ear canal, such as the length l of the remaining volume that may for example be estimated from the frequency $f_0$ of the $\lambda/4$ resonance. The corresponding teaching concerning this and other models (including statistical models, or complete models, or also approaches that base on the leak impedance, the teaching of PCT/CH2011/000277 is explicitly referred to.

The transfer impedance or the RECD estimated based on this may be stored in the hearing instrument by the fitting software and/or incorporated into the applied signal evaluation/gain characteristics of the hearing instrument.

Often, the earmold does not have a shape identical to the shape of the impression but comprises some modifications in view of its function, because of aesthetics or acoustics (e.g. leakage) or comfort or because of manufacturing reasons. Such modifications result in differences between the shape of the relevant portions of the impression and of the earmold, with an influence on the impedance or other acoustic parameters. These differences may be taken into account by calculations.

Figure 2:
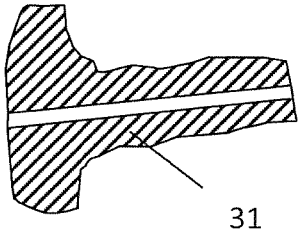
FIG. 2 shows an impression taken in accordance with FIG. 1.

FIG. 2 shows an impression 31 taken as illustrated in FIG. 1. The impression will subsequently be measured exactly and electronically. This measurement of the impression geometry, as is known in the art, serves as input for the computer aided manufacturing of the earmold, for example by rapid shell manufacturing (for example using the RSM software).

FIG. 3 depicts an according earmold 41. The earmold does not extend to the regions 42 illustrated by a dotted shading in FIG. 3, which however are part of the impression. These regions 42 are exactly known from the measurement of the impression geometry and can be taken into account precisely in the calculation of the RECD (or other acoustic quantity).

Figure 4:
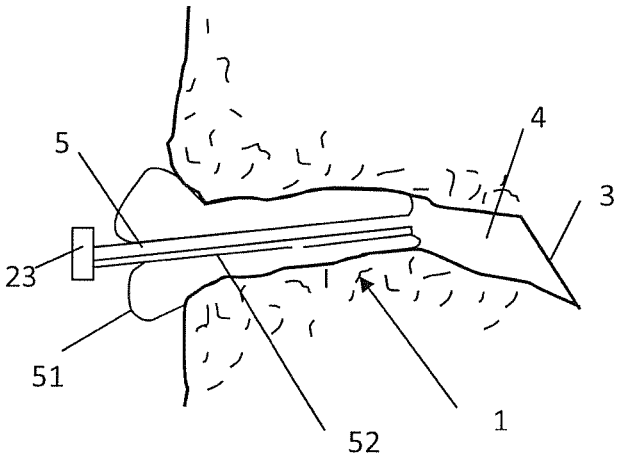
FIG. 4 shows impression taking by a balloon and scanning.

FIG. 4 shows an alternative method of impression taking. The impression tool comprises an inflatable element, namely a balloon 51 that is introduced into the ear canal and then inflated. For inflating, the tool comprises an inflating tube 52 through which air or an other gaseous or liquid substance (for example a fluorescent substance) is introduced into the balloon for inflating it. In the inflated state, the shape of the balloon is optically scanned to yield the impression of the ear canal. Also in the inflated state of the balloon, the tube 5 is used to couple the sound signal into the ear canal and to measure the acoustic signal in the ear canal by the microphone. Also in this embodiment, of course, separate tubes may be used for the receiver and the microphone.

What is claimed is:

1. A method of fitting a hearing instrument to a user's ear, the ear including an ear canal and an eardrum, the method comprising the steps of:

taking an impression of the user's ear canal by inserting an impression tool into the ear canal such that a remaining volume is defined between the impression tool and the eardrum, the impression tool including impression material, at least one measurement tube extending through the impression material and having a first end that opens into the remaining volume and a second end, a receiver in acoustic communication with the second end of the measurement tube, and a microphone in acoustic communication with the second end of the measurement tube;

performing an acoustic measurement while the impression is being taken and prior to removal of the impression tool from the ear canal by transmitting a sound signal from the receiver through the measurement tube to the remaining volume, and measuring a response acoustic signal that travels from the remaining volume through the measurement tube to the microphone; and generating geometrical data of the impression.

2. The method according to claim 1, further comprising the step of:

manufacturing an earmold based on the geometrical data of the impression.

3. The method according to claim 1, further comprising the step of:

determining an acoustic impedance from the acoustic measurement.

4. The method according to claim 3, wherein the step of determining an acoustic impedance comprises determining an acoustic ear canal impedance.

5. The method according to claim 3, further comprising the step of:

using the acoustic impedance to calculate an acoustic transfer quantity representative of a sound pressure transfer to the eardrum.

6. The method according to claim 5, further comprising the step of:

using the acoustic impedance to calculate a real-ear-to-coupler difference (RECD).

7. The method according to claim 5, further comprising the step of:

using the acoustic impedance and frequency dependent, ear independent reference characteristics of an acoustic quantity of the hearing instrument coupled to a reference acoustic coupler to calculate a real-ear-to-coupler difference (RECD).

8. The method according to claim 1, wherein the impression tool includes an elastically deformable impression stop formed from acoustically transparent material and having an inner side; and the step of taking an impression of the user's ear canal includes dispensing the impression material into the ear canal and to the inner side of the impression stop.

9. The method according to claim 1, wherein the impression tool includes an inflatable element; and the step of taking an impression of the user's ear canal includes inflating the inflatable element within the ear canal with the impression material and scanning a shape taken up by the inflated inflatable element.

10. The method according to claim 1, further comprising the step of:

based in part on information concerning a difference between a shape of the impression and a shape of the earmold, calculating an acoustic transfer quantity representative of a sound pressure transfer to the eardrum.

11. The method according to claim 1, further comprising the step of:

measuring the remaining volume between the impression tool and the eardrum by measuring at least one of an acoustic parameter when a static pressure is applied, an air flow, and a pressure difference.

12. The method according to claim 1, further comprising the step of:

prior to or during the step of taking an impression of the user's ear canal, measuring a tympanogram.

13. The method according to claim 1, wherein the transmitted sound signal is controlled by an acquisition system integrated in a behind-the-ear component of the hearing instrument; and a result of the acoustic measurement is acquired by the acquisition system.

14. An impression tool for taking an impression of an ear canal, the impression tool comprising:

an impression device, selected from the group consisting of a flow stop that confines a flow of impression material within the ear canal and an inflatable element that is inflated with impression material, that is configured to be positioned within the ear canal such that a remaining volume is defined between the impression device and the eardrum;

at least one measurement tube that extends through the impression material; and an acquisition system, including a receiver, a microphone and an electronics unit operably connected to the receiver and the microphone, acoustically coupled to the at least one measurement tube such that a sound signal emitted by the receiver will pass through the at least one measurement tube and into the remaining volume and then return from the remaining volume through the at least one measurement tube and be picked up by the microphone.

* * * * *